United States Patent [19]

Heine

[11] 4,208,618

[45] Jun. 17, 1980

[54] COMPACT SINGLE-ENDED FLUORESCENT LAMP

[75] Inventor: Thomas H. Heine, Fairmont, W. Va.

[73] Assignee: Westinghouse Electric Corp., Pittsburgh, Pa.

[21] Appl. No.: 944,229

[22] Filed: Sep. 20, 1978

[51] Int. Cl.[2] ..... H01J 8/06

[52] U.S. Cl. ..... 315/324; 313/204; 313/184

[58] Field of Search ..... 313/204, 205, 184; 315/324, 325

[56] References Cited

U.S. PATENT DOCUMENTS

| | | | |
|---|---|---|---|
| 1,963,962 | 6/1934 | Barclay | 313/204 |
| 2,121,333 | 6/1938 | Barclay | 313/204 |
| 2,459,516 | 1/1949 | Francis et al. | 313/204 |
| 2,561,868 | 7/1951 | Jenkins et al. | 315/324 |
| 3,304,457 | 2/1967 | Mastrup | 313/184 |
| 3,609,436 | 9/1971 | Campbell | 313/204 |

FOREIGN PATENT DOCUMENTS

| | | | |
|---|---|---|---|
| 1060766 | 4/1954 | France | 313/204 |

*Primary Examiner*—David K. Moore
*Attorney, Agent, or Firm*—D. S. Buleza

[57] ABSTRACT

A fluorescent lamp of high brightness and compact size is provided by constructing the envelope from two or more phosphor-coated open-ended glass tubes that are held in bundled columnar relationship by a dome-shaped cap which is also phosphor coated and defines an end chamber that is common to each of the tubes. The opposite ends of the tubes are closed and contain electrodes so that one or several arc discharges can pass between the electrodes by traversing the interconnecting end chamber and the associated tubes when the lamp is energized. If three or more arc tubes are used, operation of the lamp in either a single or multiple-discharge mode can be achieved by selectively energizing different pairs of electrodes and tubes. Operating circuits for energizing a three-tube lamp and a four-tube lamp in such a manner are disclosed.

14 Claims, 6 Drawing Figures

COMPACT SINGLE-ENDED FLUORESCENT LAMP

BACKGROUND OF THE INVENTION

1. Field of the Invention

This invention relates to electric discharge lamps and has particular reference to an improved fluorescent lamp of compact size and high brightness that is suitable for use in various kinds of residential and commercial lighting fixtures.

2. Description of the Prior Art

Electric discharge lamps having envelopes which are internally partitioned to provide one or more elongated discharge paths are well known in the art. U.S. Pat. Nos. 1,963,962 and 2,121,333 granted to Barclay disclose such lamps. U.S. Pat. No. 2,561,868 issued July 24, 1951 to Jenkins et al also discloses a multi-discharge lamp having an outer envelope which contains several open-ended arc tubes. The tubes are held in place by a baffle assembly that is attached to a stem, which is sealed to and closes the outer envelope, and by wire springs of ring-like configuration that surround the tubes and engage the wall of the outer envelope. The discharges are U-shaped and pass through adjacent pairs of tubes or follow straight paths through the tubes to a common electrode which is located at the domed end of the outer envelope.

High-pressure discharge lamps which contain a plurality of electrodes that are disposed within a common envelope and support simultaneous arc discharges are disclosed in U.S. Pat. Nos. 2,459,516 and 3,304,457.

A single-ended fluorescent lamp having a tubular envelope that contains a concentric glass cylinder and several electrodes which are sequentially energized in such a manner that the arc passes through the cylinder and sweeps around the annular chamber defined by the cylindrical partition and the envelope is disclosed in U.S. Pat. No. 3,609,436 issued Sept. 28, 1971 to Campbell.

SUMMARY OF THE INVENTION

While the aforesaid low-pressure discharge lamps of the prior art were satisfactory from a functional standpoint in that they provided compact lamps of high light output and single-ended construction, they were difficult and expensive to manufacture on a mass-production basis since they required the use of specially-formed components, such as partitioned envelopes, or employed complicated mount and stem-electrode assemblies to hold the arc tubes in place within an outer envelope.

In accordance with the present invention, the foregoing problems are overcome by constructing the envelope from a number of phosphor-coated glass tubes that are held in bundled array by a domed-end cap of glass that is joined to the open ends of the tubes and provides an interconnecting end chamber. The resulting envelope structure has a domed-columnar configuration similar to the Jefferson Memorial in Washington, D.C. and permits one or several U-shaped arc discharges to pass between electrodes located at the closed ends of the tubes by going through the common end chamber and traversing the associated pairs of tubes. In one embodiment, four arc tubes are employed and the lamp is operated in a single-discharge mode or a dual-discharge mode by connecting the terminals of a base member, which is attached to the closed ends of the tubes, to a suitable power source through an operating circuit that selectively energizes the electrodes.

In another embodiment, three arc tubes are used to provide a compact fluorescent lamp in which a single arc traverses one of the tubes and then (upon reaching the end chamber) splits or divides into two arcs that pass through the remaining pair of tubes.

Since the basic components of the envelope assembly consist of pieces of straight glass tubing and cathodes of the type commonly employed in conventional fluorescent lamps and an outer envelope or a complicated mount assembly are not required, the lamp can be readily fabricated from inexpensive components available to those in the art.

Various novel lighting effects can also be obtained by coating the tubes with phosphors which emit light of different colors and by providing switches in the operating circuit which control the number of tubes which are energized—thus providing a light output of variable color and different brightness levels;

BRIEF DESCRIPTION OF THE DRAWINGS

A better understanding of the invention will be obtained from the exemplary embodiments shown in the accompanying drawings, wherein.

DESCRIPTION OF THE PREFERRED EMBODIMENTS

While the present invention can be advantageously employed in various kinds of electric discharge lamps that are suited (by virtue of their physical size and light output) for lighting homes or offices, it is particularly adapted for use in conjunction with low-pressure type discharge lamps such as single-ended fluorescent lamps and it has, accordingly, been so illustrated and will be so described.

Figure 1:
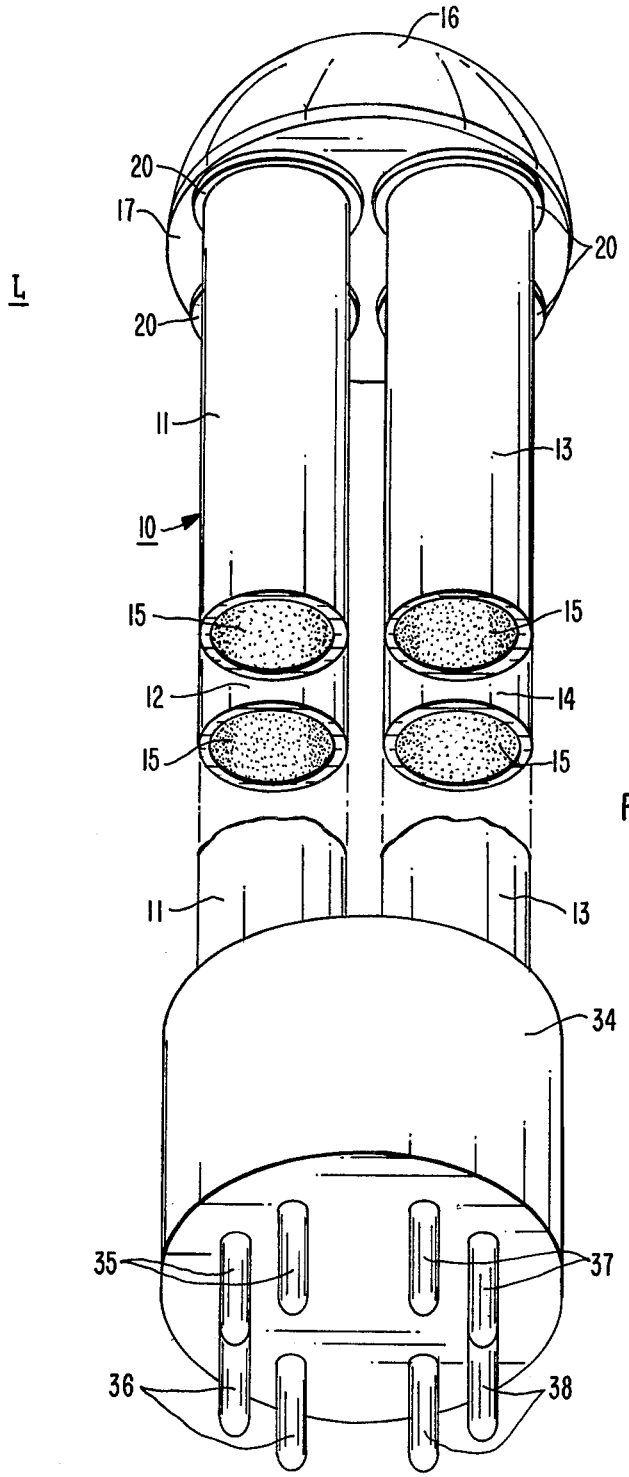
FIG. 1 is a pictorial view of a compact "Jefferson Memorial" type (fluorescent lamp that embodies the invention, parts of the tubular segments of the envelope being removed for illustrative purposes.

A fluorescent lamp L of such construction is shown in FIG. 1 and comprises an envelope 10 having four tubular members such as glass arc tubes 11, 12, 13 and 14 that are held in bundled quadrangular array by a dome-shaped glass end cap 16 which is coated with phosphor and hermetically joined to the open ends of the tubes by a suitable header such as a ceramic disk 17 that has circular bosses 20 on its lower face. The inner surfaces of the arc tubes are coated with a layer 15 of suitable phosphor and the end cap 16 provides an end chamber that is common and accessible to the open ends of each of the tubes and thus serves as an interconnecting chamber. The basic structure of the envelope 10 is thus very similar to the columnar-domed design used in the Jefferson Memorial at Washington, D.C.

Figure 2:
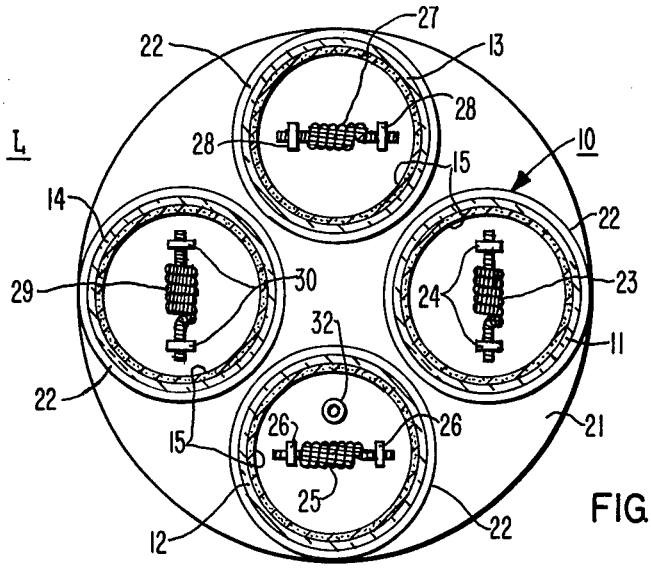
FIG. 2 is an enlarged cross-sectional view through the envelope portion of the lamp shown in FIG. 1.
Figure 3:
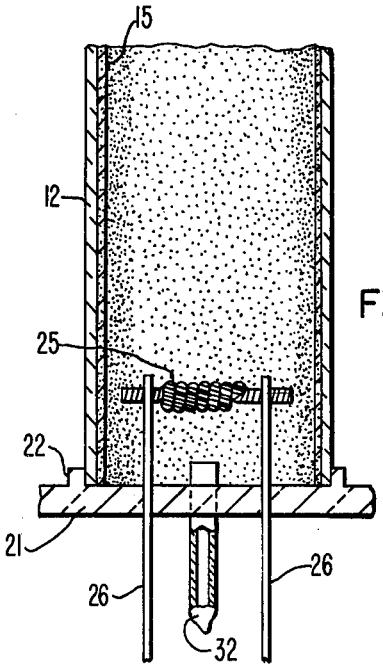
FIG. 3 is a longitudinal sectional view of the closed end of one of the tubular segments of the lamp envelope.

As illustrated in FIGS. 2 and 3, the opposite ends of the arc tubes 11, 12, 13 and 14 are hermetically closed by a transversely-extending cover member, such as another ceramic disc 21, that has four circular-shaped flanges or bosses 22 which are dimensioned to snugly receive the ends of the tubes and are joined to them in an airtight manner, preferably by means of a suitable rotatable glaze or glass frit that is fused and bonds the members together. The closed ends of the tubes 11, 12, 13 and 14 are each provided with a thermionic electrode 23, 25, 27 and 29, respectively, that are fastened to suitable lead-in conductors such as paired lead wires 24, 26, 28 and 30 which extend through and are sealed to the ceramic disc 21. The electrodes are of the usual type employed in fluorescent lamps and thus consist of a helical coil of tungsten wire that is coated with a suitable electron-emissive material well known to those skilled in the art.

Evacuation of the "four-tube" envelope 10 is achieved by providing one of the arc tubes (tube 12, as shown in FIGS. 2 and 3) with a glass exhaust tubulation 32 that is sealed through the ceramic disc 21 and has its outer end tipped off and sealed in the usual fashion after the envelope has been evacuated and charged with an ionizable medium such as a fill gas and a measured dose of mercury. A suitable fill gas is argon at a pressure of about 3 torr. The mercury dosage will vary according to the physical size of the envelope 10 and the power loading of the lamp L and is sufficient to provide mercury vapor at a partial pressure of from about 6 to 10 microns when the lamp L is operated at its rated wattage. The resulting electric discharges that pass between the energized electrodes generate ultraviolet radiations which strike the phosphor coatings 15 on the inner surfaces of the tubes and excite the phosphor to emit visible radiations of the desired character.

As will be noted in FIG. 1, the closed ends of the envelope tubes 11, 12, 13 and 14 are coupled to a suitable base member 34, for example by fastening the ceramic disc 21 (not shown) to either the rim or inner periphery of the base. As illustrated, the base member 34 is desirably of cylindrical configuration to nestingly accommodate the circular disc and is of sufficient depth to enclose the tipped-off end segment of the exhaust tubulation 32 (not shown) and the protruding ends of the lead wires 24, 26, 28 and 30 (also not shown). Four pairs of suitable terminals such as metal prongs or pins 35, 36, 37 and 38 protrude from the bottom of the base member 34 and are fastened (as by soldering or the like) to the four pairs of lead wires, thus providing a compact fluorescent lamp L that can be plugged into a suitable socket that constitutes a part of the table lamp or other lighting fixture in which the lamp will be used.

While the arc tubes 11, 12, 13 and 14 are all of circular cross section and the same size, tubes of non-circular shape (elliptical, for example) and different sizes can be used if desired.

LAMP MANUFACTURE (FIG. 4)

Figure 4:
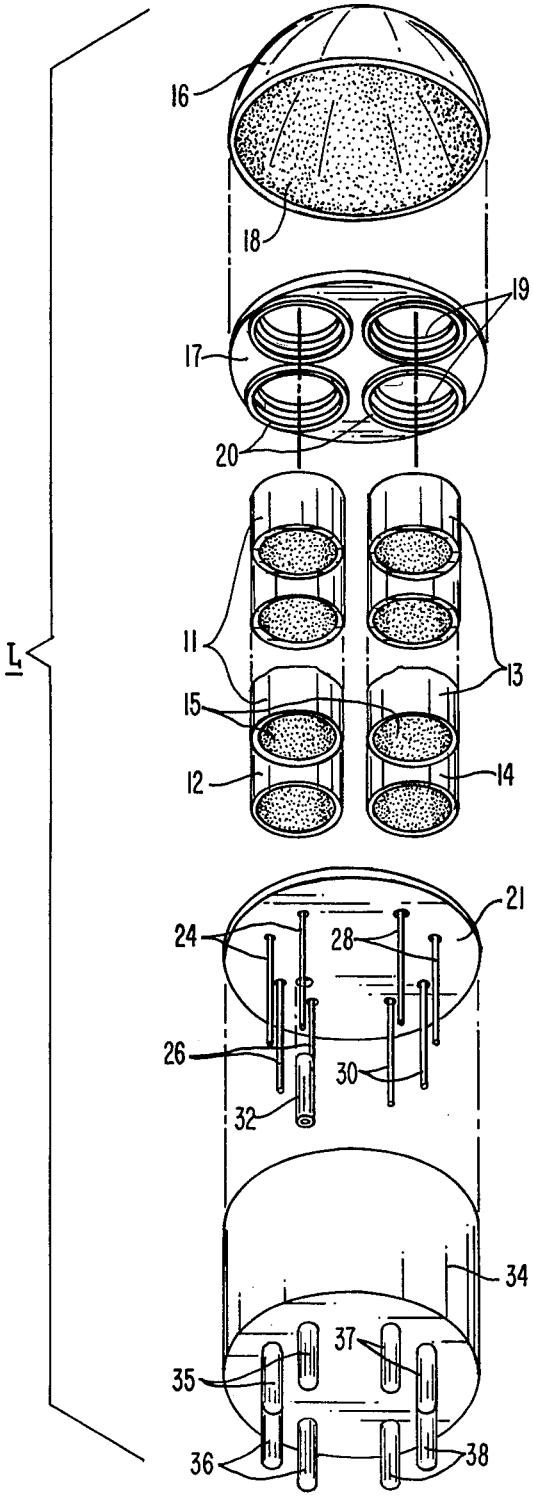
FIG. 4 is an exploded view of the various lamp components showing the manner in which they are assembled.

The manner in which the fluorescent lamp L is assembled is shown in FIG. 4. The glass arc tubes 11, 12, 13 and 14 and glass dome 16 are first coated with a suitable phosphor "paint" and lehred in the usual manner to remove the binder ingredients, etc. and provide the tubes with a thin inner coating 15 of phosphor and the interior surface of the dome with a similar phosphor coating 18.

The top surface of the coupling disc 17 can also be phosphor coated in the same manner, if desired. The dome 16 is then seated on top of the ceramic disc 17 and the open ends of the tubes 11, 12, 13 and 14 are inserted into the disc apertures 19 in nested relationship with the circular bosses 20 provided on the bottom face of the disc. The opposite ends of the arc tubes are then inserted into the circular bosses (not shown) on the top surface of the other ceramic disc 21 and are seated against the disc so that the respective electrodes (also not shown) are enclosed by the tubes. In a previous series of operations, the lead wire pairs 24, 26, 28 and 30 and the glass exhaust tube 32 are inserted into suitable openings in the bottom disc 21 and hermetically joined to the disc, and the electrodes are fastened to the ends of the paired lead wires to form separate subassembly which is seated against the ends of the arc tubes in the manner just described.

The interfitted portions of the various envelope components are then coated with a suitable glaze or glass frit and the entire assembly is placed in a furnace and heated to melt the frit and hermetically seal all of the joints and thus provide an integral unit. While various kinds of glazing frits can be employed, satisfactory results have been obtained with a frit identified as formula "PZ 13" in a paper entitled "The Development of Some Very Soft Glasses" published by Dale & Stanworth, Journal of the Society of Glass Technology, 1949, Vol. 33, pp. 167–175. This frit contains (by weight) 72.5% PbO, 15% ZnO, 12.5% $B_2O_5$ and 0.86% $SiO_2$. The raw mix composition is first fired to form a fused glassy material which is then powdered and suspended in a suitable liquid medium (such as nitrocellulose lacquer) to form a glazing frit composition that is applied to the mechanically interfitted parts which are to be hermetically joined.

After the assembled multi-tube envelope 10 has been evacuated and charged with fill gas and mercury through the glass tubulation 32, the tubulation is tipped off and the envelope is inserted into the base member 34 and oriented so that the paired lead wires 24, 26, 28 and 30 pass through holes in the ends of the paired terminal pins 35, 36, 37 and 38, respectively. The ceramic disc 21 is then secured to the base shell by suitable means, such as cement, and the protruding ends of the lead wires are severed and the wires connected to the pins by soldering or other means.

The finished fluorescent lamp L according to this particular embodiment is thus of the plug-in type that can be inserted into and removed from a lighting fixture which includes a socket (or suitable adaptor) that is designed to receive such a plug-in base and is also provided with circuit means for operating the discharge lamp unit. Of course, a multi-contact screw type base can be used instead of the plug-in base if desired.

While the lamp L illustrated in FIGS. 1–4 has four arc tubes of circular cross section that are arranged in spaced quadrangular configuration, it will be understood by those skilled in the art that the invention is not limited to this particular design and that a smaller or greater number of tubes can be employed if desired. For example, a single pair of arc tubes can be used to provide a lamp having single U-shaped arc discharge that passes through one of the tubes, through the domed end cap and into the other tube. If an even number of tubes greater than two is employed, then multiple arcs between different pairs of electrodes will be obtained with the arcs passing through the associated pairs of tubes after simultaneously entering, sharing and exiting the common end chamber during part of their travel between the electrodes. The fact that the arcs can be made to mingle and merge within the dome or end chamber and then separate to follow the proper paths between the electrode pairs is rather surprising and results in a remarkable simplification of the design and manufacture of single-ended compact fluorescent lamps. Actually, it has been found that when one arc has been established through the end chamber, the other arcs are much easier to start.

An odd number of arc tubes greater than one can also be employed—with three of the tubes and their electrodes being operated as a functional unit in a manner such that the arc passes through one of the tubes as a single or main discharge which splits or divides, as it traverses the dome, into two separate arcs which enter the other two tubes of the "tri-tube" unit. As will be apparent to those skilled in the art, such a "tri-tube" functional unit can be combined with additional pairs of arc tubes to provide a compact discharge lamp that has five, seven, nine, etc. tubes and at least one arc discharge that divides into two discharges and is supplemented by one or more additional U-shaped discharges that pass through the additional pairs of arc tubes.

DUAL-ARC FLUORESCENT LAMP AND OPERATING CIRCUIT (FIG. 5)

Figure 5:
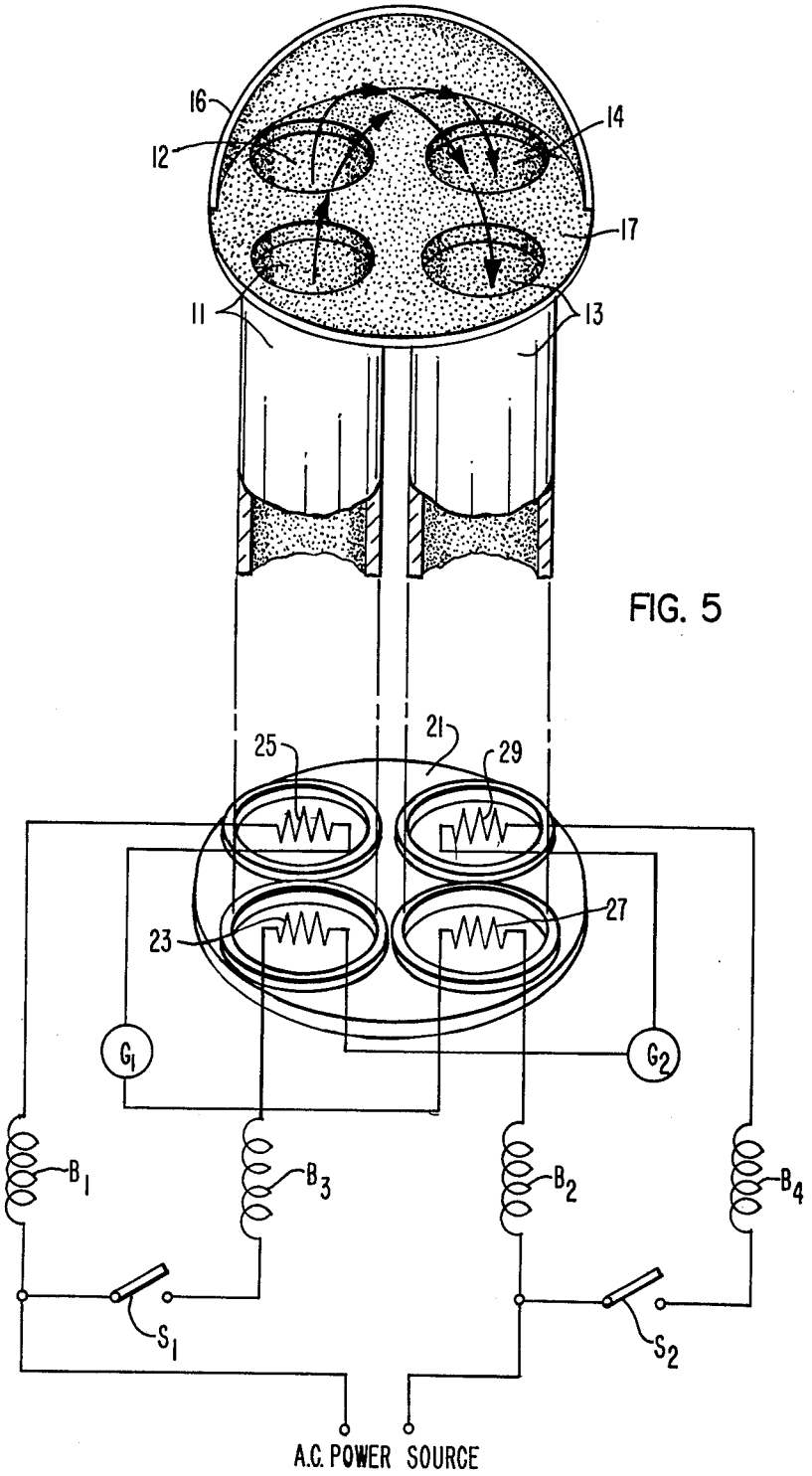
FIG. 5 is a simplified view of the "four tube" lamp embodiment shown in the previous figures and a schematic of a circuit for controlling the operation of the lamps.

A "dual-discharge" type fluorescent lamp L having two pairs of arc tubes and associated electrode pairs that provide two U-shaped arc discharges pursuant to the invention is shown in FIG. 5, along with a circuit for operating and controlling the arcs and obtaining different lighting effects.

As illustrated, the lamp L is of the "four-tube" design previously described and the electrodes are energized in a manner such that one of the U-shaped arcs passes through the phosphor-coated tubes 11 and 14 between the associated electrodes 23 and 29, while the other arc traverses tubes 12 and 13 between the remaining pair of electrodes 25 and 27—with the arcs (as indicated by the arrows) simultaneously traversing, mingling and then sorting themselves out within the common end chamber that is defined by the phosphor-coated end dome 16.

The arcs can be independently or simultaneously operated by employing a suitable energizing circuit. Such a circuit is shown in FIG. 5 and connects electrode 25 to one terminal of an alternating-current power source through a suitable choke ballast $B_1$, and the other end of electrode 25 to its paired electrode 27 through a glow switch starter $G_1$. The other end of electrode 27 is connected to the other terminal of the AC power supply through a second choke ballast $B_2$.

The other pair of electrodes 23 and 29 are connected to each other by suitable conductors through a second glow switch $G_2$, and to the AC power source by conductors which connect the other end of electrode 23 to one of the power terminals through a third choke ballast $B_3$ and a switch $S_1$. The other end of electrode 29 is similarly connected to the other power terminal through another choke ballast $B_4$ and a second switch $S_2$.

The aforementioned glow switch starters and choke ballasts are of the type conventionally employed in fluorescent lamp operating circuits and are thus well known to those skilled in the art.

When switches $S_1$ and $S_2$ are both closed, all four arc tubes operate and maximum light intensity or brightness is obtained from the lamp L. When switch $S_1$ is open, arc tube 11 and its associated electrode 23 are inoperative and the remaining three arc tubes 12, 13 and 14 and their electrodes 25, 27 and 29 are energized and sustain a single arc discharge which traverses tube 12 and then divides into two discharges (as it passes through the domed end chamber) which enter and traverse the other tubes 13 and 14. Since the lamp current in the single discharge is also divided when the single discharge splits into two discharges, the main arc in tube 12 is more intense than the arcs in tubes 13 and 14 and tube 12 thus operates at a higher brightness or a light-intensity level than tubes 13 and 14.

When switch $S_1$ is closed and switch $S_2$ is open, electrode 29 and its associated arc tube 14 are rendered inoperative and the main arc traverses tube 13 and automatically splits within the dome 16 into two arcs which traverse the other energized tubes 11 and 12.

With switches $S_1$ and $S_2$ both open, only electrodes 25 and 27 are energized and only their associated arc tubes 12 and 13 are operative so that only a single U-shaped discharge is obtained, with the result that the lamp L operates at a much lower brightness or output than when three or all four tubes are lit.

Hence, three different lighting levels can be obtained by selectively energizing and operating the arc tubes so that they operate in groups of two, three or four. Of course, a main switch (not shown) can also be included in the operating circuit to completely de-energize the fluorescent lamp L, and all of the switches can also be combined in a single unit to permit the lamp to be turned on or off or operated in the various modes and at the different lighting levels by actuating the switch unit.

If the tubes are coated with phosphors which emit light of a different color or wavelength, then the color of the light produced by the fluorescent lamp L can also be changed along with the light-intensity by manipulating switches $S_1$ and $S_2$.

Tests of experimental "four-tube" lamps made in accordance with the invention have indicated that a total light output of around 1250 lumens can be obtained with a power input of about 25 watts by using four arc tubes approximately 18 cms. long and 10 mm. in diameter coated with "cool white" phosphor.

SPLIT-DISCHARGE FLUORESCENT LAMP AND OPERATING CIRCUIT (FIG. 6)

Figure 6:
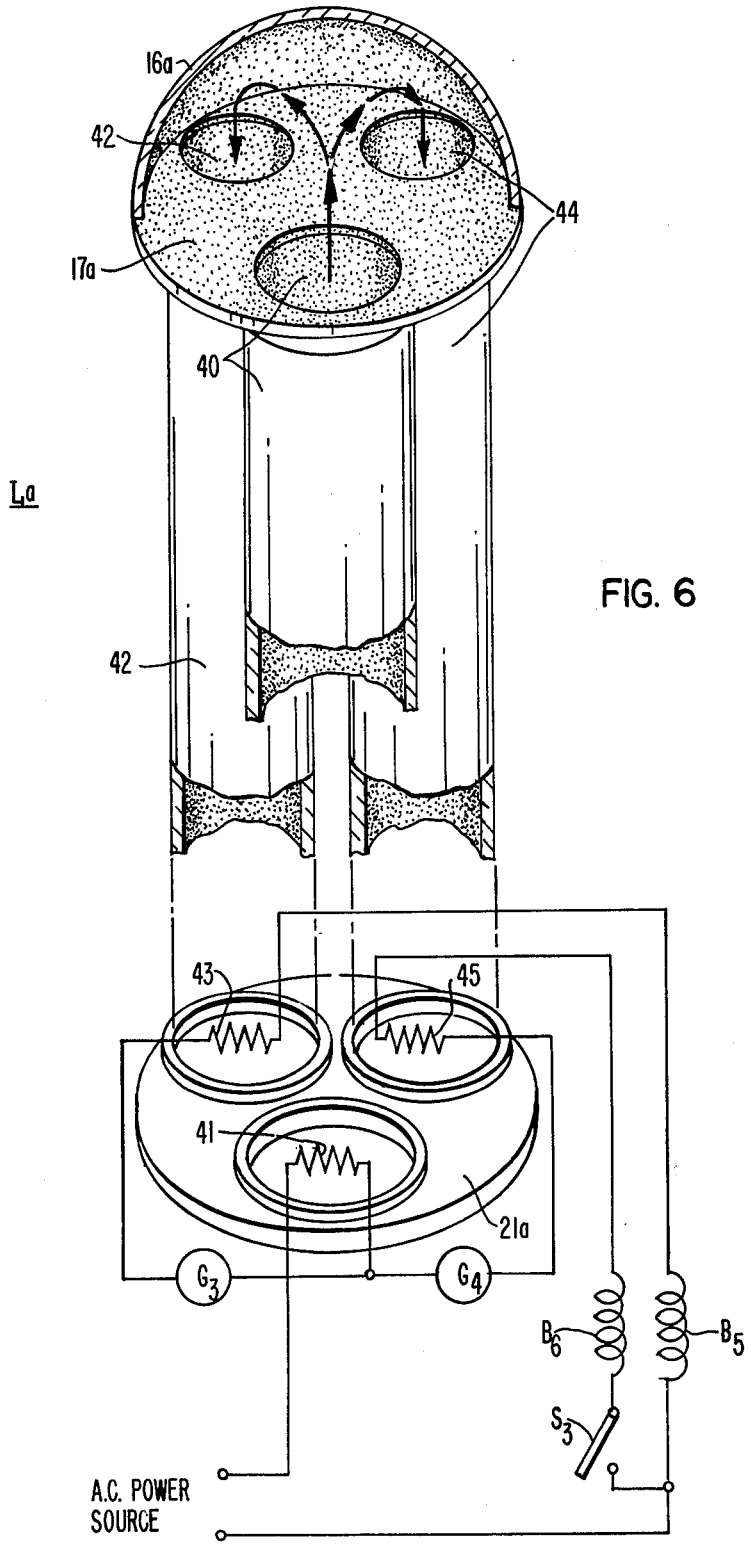
FIG. 6 is a similar view of an alternative lamp embodiment wherein three tubes are employed to provide a main discharge that automatically splits into a pair of discharges, a representative lamp-operating circuit being shown in schematic form.

An alternate fluorescent lamp embodiment $L_A$ that employs three arc tubes and associated electrodes that are coupled to a circuit that permits the lamp to be operated at two different lighting levels are illustrated in FIG. 6 and will now be described.

As shown, arc tube 40 is of circular cross section and of larger diameter than the other two arc tubes 42 and 44 (which are also circular in cross section), and the arc tubes are arranged in triangular-columnar configuration so that their open ends communicate with the common end chamber defined by the domed end cap 16*a*. As in the previous embodiment, the inner surfaces of the arc tubes, the dome 16*a* and ceramic coupling disc 17*a* are all coated with a suitable phosphor or phosphors. If desired, one or more of the arc tubes can be of non-circular cross section.

The electrodes 41, 43 and 45 associated with arc tubes 40, 42 and 44, respectively, are mounted on the bottom ceramic disc 21*a* and are connected to an operating circuit which permits the tubes to be operated in two different lighting modes. As shown, one end of electrode 41 is connected directly to the AC power source and its other end is connected through glow switch starters $G_3$ and $G_4$ to electrodes 43 and 45, respectively. The other end of electrode 43 is connected to the other terminal of the power source through a choke ballast $B_5$, and the other end of electrode 45 is connected to the same power terminal through another choke ballast $B_6$ and a switch $S_3$.

When switch $S_3$ is closed, all three arc tubes 40, 42 and 44 operate with the main arc passing through the large-diameter tube 40 and splitting into two arcs (within dome 16$_a$) that enter and traverse the remaining tubes 42 and 44, as indicated by the arrows within the dome. With switch $S_3$ open, only electrodes 41 and 43 are energized and only the associated arc tubes 40 and 42 operate, thus providing a single U-shaped discharge and a much lower lighting level.

As in the previous embodiment, switch $S_3$ can be combined with an on-off switch (not shown) in a single unit which permits the fluorescent lamp $L_A$ to be completely de-energized or selectively operated in either of the two different lighting modes and brightness levels. The color of the light produced by the lamp at the different evels can also be varied by coating the arc tubes 40, 42 and 44 with phosphors that emit visible radiations in different regions of the spectrum.

I claim as my invention:

1. A single-ended low-pressure electric discharge lamp adapted for use as a compact light source in fixtures designed for residential and commercial lighting applications, said lamp comprising:

a sealed light-transmitting envelope formed by a plurality of hollow tubular members that are disposed in bundled columnar array and are hermetically joined to a hollow cap-like component that defines an end chamber which communicates with and is common to the open ends of each of the tubular members, the ends of each of said tubular members opposite said cap-like component being closed and coupled to base means having terminals;

a single electrode disposed within each of said tubular members;

lead-in conductors extending into the respective tubular members and connecting the associated electrodes with the base terminals; and an ionizable medium within the columnar-shaped envelope adapted to sustain an electric discharge between a selected pair of said electrodes, when the lamp is energized, so that the discharge passes through said common end chamber and then extends into the respective individual tubular members which contain the electrodes that comprise the said selected pair of electrodes.

2. The compact electric discharge lamp of claim 1 wherein the closed ends of said tubular members are each hermetically joined to a transversely-extending support means which, together with the cap-like component, holds the tubular members in their columnar-arrayed positions.

3. The compact electric discharge lamp of claim 1 wherein;

said columnar-shaped envelope comprises said cap-like component and two tubular members, and the electrodes are disposed at the closed ends of the respective tubular members and said electric discharge is thus of generally U-shaped configuration.

4. The compact electric discharge lamp of claim 1 wherein:

said columnar-shaped envelope comprises said cap-like component and a number of tubular members greater than two; and said ionizable medium is adapted to sustain a plurality of electric discharges between different pairs of said electrodes, said discharges simultaneously passing through the end chamber as they leave and enter the respective tubular members which contain said different pairs of electrodes.

5. The compact electric discharge lamp of claim 4 wherein:

said columnar-shaped envelope comprises said cap-like component and an even number of tubular members greater than two; and the base terminals connected to the respective different pairs of electrodes are coupled to circuit means, when the lamp is energized, which is adapted to permit the said electrode pairs to be selectively connected to the electric power source so that the lamp can be operated in a single discharge mode, a multiple-discharge mode, or a split-discharge mode.

6. The compact electric discharge lamp of claim 4 wherein:

said columnar-shaped envelope comprises said cap-like component and an odd number of hermetically-joined tubular members greater than one; and the base terminals connected to three of the electrodes that are disposed within three of said tubular members are coupled to circuit means, when the lamp is energized, which is adapted to permit two of the said three electrodes to be selectively energized as a pair or along with the third electrode so that the resulting discharge either (a) passes directly between two of the said three electrodes through the end chamber and associated pair of tubular members, or (b) between each of the said three electrodes by traversing one of the associated tubular members in the form of a single arc which, upon reaching the common end chamber, splits into two separate arcs that traverse the remaining two associated tubular members.

7. The compact electric discharge lamp of claim 1 wherein;

said ionizable medium includes a fill gas and mercury which provide an arc discharge that generates ultraviolet radiations when the lamp is energized, and the inner surfaces of said hollow tubular members and cap-like component are coated with an ultraviolet-responsive phosphor and said lamp thus comprises a fluorescent lamp.

8. The compact fluorescent lamp of claim 7 wherein:

said hollow tubular members comprise glass tubes, said hollow cap-like component comprises a dome-shaped glass member that is joined to the respective tubes by a header having apertures that accommodate the open ends of said tubes the ends of the glass tubes that are remote from the dome-shaped member are joined to a transverse closure member that is composed of electrically non-conductive material, and said lead-in conductors comprise wires that extend through the non-conductive closure member in paired relationship and are fastened to and support the respective electrodes at the closed ends of the associated glass tubes.

9. The compact fluorescent lamp of claim 8 wherein said columnar-shaped envelope comprises said domed-shaped member and four glass tubes that are disposed in spaced side-by-side quadrangular relationship so that two electric discharges simultaneously traverse the end chamber and respective tubes when all four electrodes are energized.

10. The compact fluorescent lamp of claim 9 wherein;

said closure member and header both comprise discs of insulating material, and a sealed exhaust tubulation extends into the closed end of one of the glass tubes through the associated disc.

11. The compact fluorescent lamp of claim 10 wherein said base means comprises a base member that is secured to the closure disc, encloses the protruding portions of said lead wires and exhaust tubulation, and has four pairs of exposed terminals that are connected to said lead wires.

12. The compact fluorescent lamp of claim 9 wherein each of said glass tubes are of circular cross-section and have substantially the same diameter.

13. The compact fluorescent lamp of claim 8 wherein;

said columnar-shaped envelope comprises said dome-shaped member and three glass tubes that are arranged in spaced side-by-side triangular relationship, and said closure member and header are both of disc-like configuration.

14. The compact fluorescent lamp of claim 13 wherein each of said glass tubes are of circular cross-section and one of the tubes has a diameter that is larger than that of the other tubes.

* * * * *